US012546512B2

(12) United States Patent
Wu et al.

(10) Patent No.: US 12,546,512 B2
(45) Date of Patent: Feb. 10, 2026

(54) MULTI-STAGE COMPRESSOR AND AIR CONDITIONING UNIT

(71) Applicant: Gree Electric Appliances, Inc. of Zhuhai, Guangdong (CN)

(72) Inventors: Xiaokun Wu, Guangdong (CN); Ying Li, Guangdong (CN); Zhongkeng Long, Guangdong (CN); Chiliang Luo, Guangdong (CN); Haomin Lian, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 131 days.

(21) Appl. No.: 18/688,564

(22) PCT Filed: Jul. 26, 2022

(86) PCT No.: PCT/CN2022/107751
§ 371 (c)(1),
(2) Date: Mar. 1, 2024

(87) PCT Pub. No.: WO2023/109130
PCT Pub. Date: Jun. 22, 2023

(65) Prior Publication Data

US 2025/0123030 A1 Apr. 17, 2025

(30) Foreign Application Priority Data

Dec. 14, 2021 (CN) ..... 202111526275.5

(51) Int. Cl.
*F25B 1/10* (2006.01)
*F25B 41/40* (2021.01)
(Continued)

(52) U.S. Cl.
CPC ..... *F25B 1/10* (2013.01); *F25B 41/40* (2021.01); *F25B 43/003* (2013.01); *F24F 5/001* (2013.01); *F25B 31/026* (2013.01)

(58) Field of Classification Search
CPC ..... F25B 1/10; F25B 41/40; F25B 43/003; F25B 43/00; F25B 31/026; F25B 31/00;
(Continued)

(56) References Cited

U.S. PATENT DOCUMENTS 4,369,633 A * 1/1983 Snyder ..... F04B 25/02 417/349
2003/0136145 A1 7/2003 Perevozchikov et al.
(Continued)

FOREIGN PATENT DOCUMENTS

CN 101405547 A 4/2009
CN 102232167 A * 11/2011 ..... F25B 43/006
(Continued)

OTHER PUBLICATIONS

EP 22905892, Extended European Search Report, Dec. 19, 2024.

*Primary Examiner* — Emmanuel E Duke
(74) *Attorney, Agent, or Firm* — The Webb Law Firm

(57) ABSTRACT

The present disclosure provides a multi-stage compressor and an air conditioning unit. The multi-stage compressor includes a flash tank, which is arranged in the multi-stage compressor, a refrigerant inlet of the flash tank is configured to be communicated with a condenser, a vapor outlet of the flash tank is communicated with a high-pressure-stage suction port of the multi-stage compressor, and a liquid outlet of the flash tank is configured to be communicated with an evaporator. The multi-stage compressor and the air conditioning unit of the present disclosure effectively improve compressor efficiency.

12 Claims, 3 Drawing Sheets

(51) Int. Cl.
*F25B 43/00* (2006.01)
*F24F 5/00* (2006.01)
*F25B 31/02* (2006.01)

(58) Field of Classification Search
CPC ..... F25B 2400/13; F24F 5/001; F01C 21/10; F04C 23/001; F04C 18/16; F04C 2240/30; F04C 29/00; F04C 29/0092
See application file for complete search history.

(56) References Cited

U.S. PATENT DOCUMENTS

| | | | | |
|---|---|---|---|---|
| 2011/0023514 | A1 | 2/2011 | Mitra et al. | |
| 2011/0162397 | A1* | 7/2011 | Huff | F25B 1/10 62/132 |
| 2015/0096315 | A1* | 4/2015 | Li | F25B 43/00 62/509 |
| 2017/0268809 | A1* | 9/2017 | Zhou | F25B 43/006 |
| 2021/0348809 | A1* | 11/2021 | Bouquet | F25B 13/00 |

FOREIGN PATENT DOCUMENTS

| | | | | | |
|---|---|---|---|---|---|
| CN | 104344610 | A | | 2/2015 | |
| CN | 104912800 | A | | 9/2015 | |
| CN | 106762630 | A | | 5/2017 | |
| CN | 107144047 | A | | 9/2017 | |
| CN | 107559195 | A | | 1/2018 | |
| CN | 208793221 | U | | 4/2019 | |
| CN | 110307660 | A | | 10/2019 | |
| CN | 110869687 | B | * | 11/2021 | F25J 3/04357 |
| CN | 114165446 | A | | 3/2022 | |
| CN | 216788710 | U | | 6/2022 | |
| EP | 3534009 | A1 | | 9/2019 | |
| EP | 2737264 | B1 | * | 7/2020 | F25B 1/10 |
| JP | H06939997 | A | | 4/1994 | |
| JP | 2006329557 | A | | 12/2006 | |
| JP | 2009186033 | A | | 8/2009 | |
| JP | 2011503504 | A | * | 1/2011 | F25D 29/003 |
| KR | 1020110087778 | A | | 8/2011 | |
| WO | 2007109250 | A2 | | 9/2007 | |
| WO | WO-2020057452 | A1 | * | 3/2020 | F04C 18/02 |

* cited by examiner

MULTI-STAGE COMPRESSOR AND AIR CONDITIONING UNIT

CROSS-REFERENCE TO RELATED APPLICATIONS

This application is the United States national phase of International Patent Application No. PCT/CN2022/107751, filed Jul. 26, 2022, and claims priority to Chinese Patent Application No. 202111526275.5, filed Dec. 14, 2021, the disclosures of which are hereby incorporated by reference in their entireties.

BACKGROUND OF THE INVENTION

Field of the Invention

The present disclosure relates to the field of refrigeration technology, in particular to a multi-stage compressor and an air conditioning unit.

Description of Related Art

A multi-stage compressor (such as a screw compressor) is a major part of a commercial air conditioning unit, and is called the "heart" of a commercial air conditioner. At present, large commercial air conditioning units commonly use a compressor and an external make-up air structure (such as an external plate heat exchanger), to adjust the exhaust temperature of the compressor and increase the refrigeration capacity. However, such an external structure has a complex pipeline, and a large pressure loss, which affects the efficiency of the compressor.

In the related technologies known to the inventor, the complex pipeline and the large pressure loss of the external make-up structure of the compressor result in low efficiency of the compressor.

SUMMARY OF THE INVENTION

In order to achieve the above object, according to an aspect of the present disclosure, there is provided a multi-stage compressor including a flash tank, which is arranged in the multi-stage compressor, wherein a refrigerant inlet of the flash tank is configured to be communicated with a condenser, a vapor outlet of the flash tank is communicated with a high-pressure-stage suction port of the multi-stage compressor, and a liquid outlet of the flash tank is configured to be communicated with an evaporator.

In some embodiments, the multi-stage compressor includes a housing, which is formed with a flash chamber and a liquid storage area of the flash tank, the liquid storage area being located below the flash chamber, wherein the refrigerant inlet and the liquid outlet are both provided on the housing, and the vapor outlet and the high-pressure-stage suction port are both located inside the housing.

In some embodiments, the multi-stage compressor further includes a high-pressure-stage structure and a low-pressure-stage structure provided inside the housing, and the flash tank is located between the high-pressure-stage structure and the low-pressure-stage structure.

In some embodiments, the high-pressure-stage structure and the low-pressure-stage structure are disposed symmetrically and connected by a coupling; and the flash chamber is located at a position of the coupling, and the liquid storage area is located below the coupling.

In some embodiments, the refrigerant inlet is communicated with the flash chamber and located above the flash chamber; and the liquid outlet is communicated with the liquid storage area.

In some embodiments, a baffle plate is provided inside the housing, and the baffle plate is located between the coupling and the liquid storage area.

In some embodiments, a porous filter screen is provided inside the housing, and the porous filter screen is located between the coupling and the liquid storage area.

In some embodiments, the flash tank includes a tank structure, which is arranged in the interior of the multi-stage compressor, the tank structure forming a flash chamber and a liquid storage area of the flash tank.

In some embodiments, the tank structure is located on an exhaust side of the multi-stage compressor.

In some embodiments, the multi-stage compressor further includes a high-pressure-stage structure and a low-pressure-stage structure provided inside the multi-stage compressor, and the tank structure is located between the high-pressure-stage structure and the low-pressure-stage structure.

In some embodiments, the multi-stage compressor is a two-stage compressor.

According to another aspect of the present disclosure, an air conditioning unit is provided, which includes the multi-stage compressor described above.

In some embodiments, the air conditioning unit further includes the condenser and the evaporator, the condenser being communicated with the refrigerant inlet of the flash tank, and the evaporator being communicated with the liquid outlet of the flash tank.

DESCRIPTION OF THE INVENTION

Further detailed description of the present disclosure is provided below in conjunction with the accompanying drawings and particular embodiments, but without limiting the present disclosure.

A multi-stage compressor and an air conditioning unit are provided in embodiments of the present disclosure to solve the problem of low compressor efficiency in the related technologies.

The structure in which the flash tank is arranged in the compressor enables an enthalpy difference of a main loop refrigerating agent entering the evaporator to be increased, which increases the refrigeration capacity of the compressor per unit mass of refrigerating agent, and further improves the efficiency of the compressor. Compared with a compressor and an external make-up air structure in the prior art, the present disclosure enables a flash tank to be arranged in a compressor, which can reduce or even dispense with an external pipeline to reduce a pressure loss caused by pipeline connection, and reducing the pressure loss can effectively improve compressor efficiency. In addition, the flash tank being built in the compressor can make the complete air conditioning unit more compact and reduce the footprint.

Figure 1:
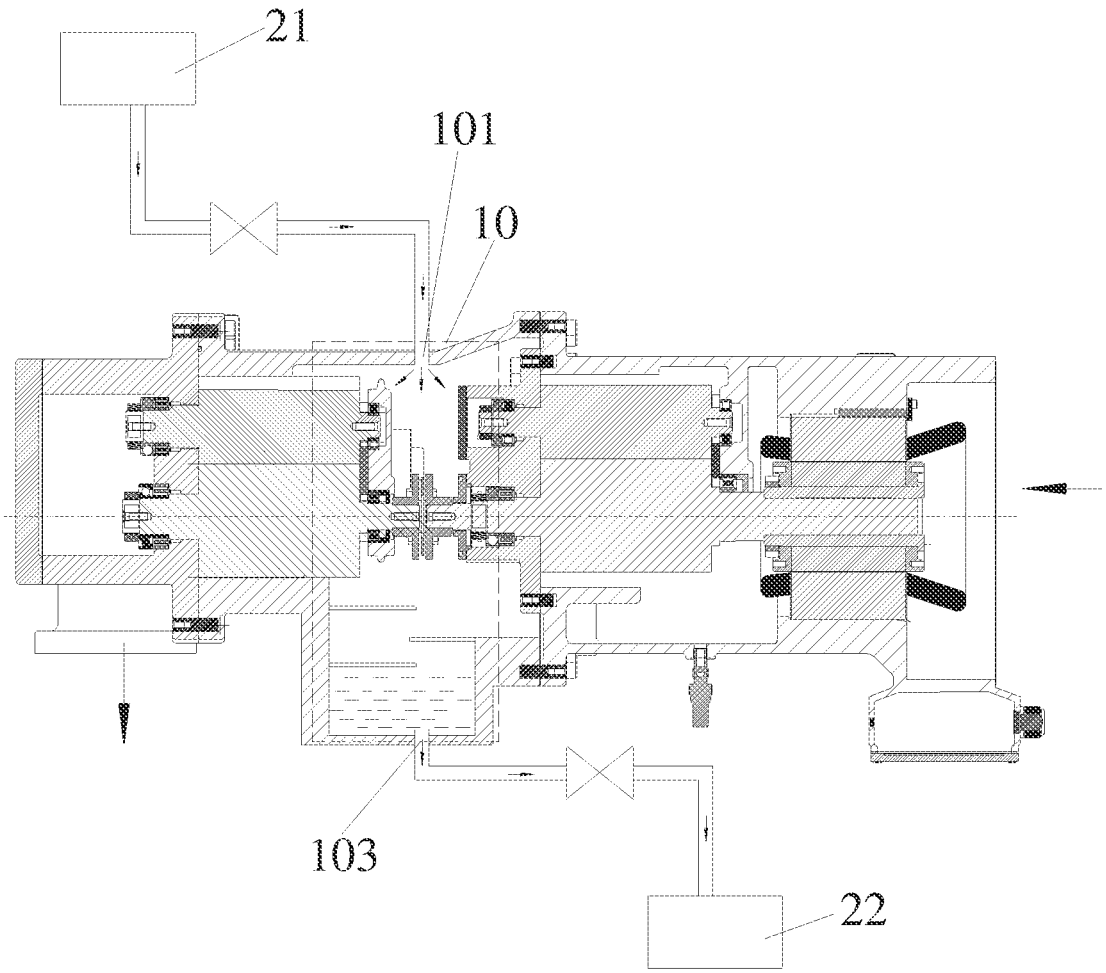
FIG. 1 is a structural diagram of a multi-stage compressor in Embodiment I of the present disclosure.
Figure 2:
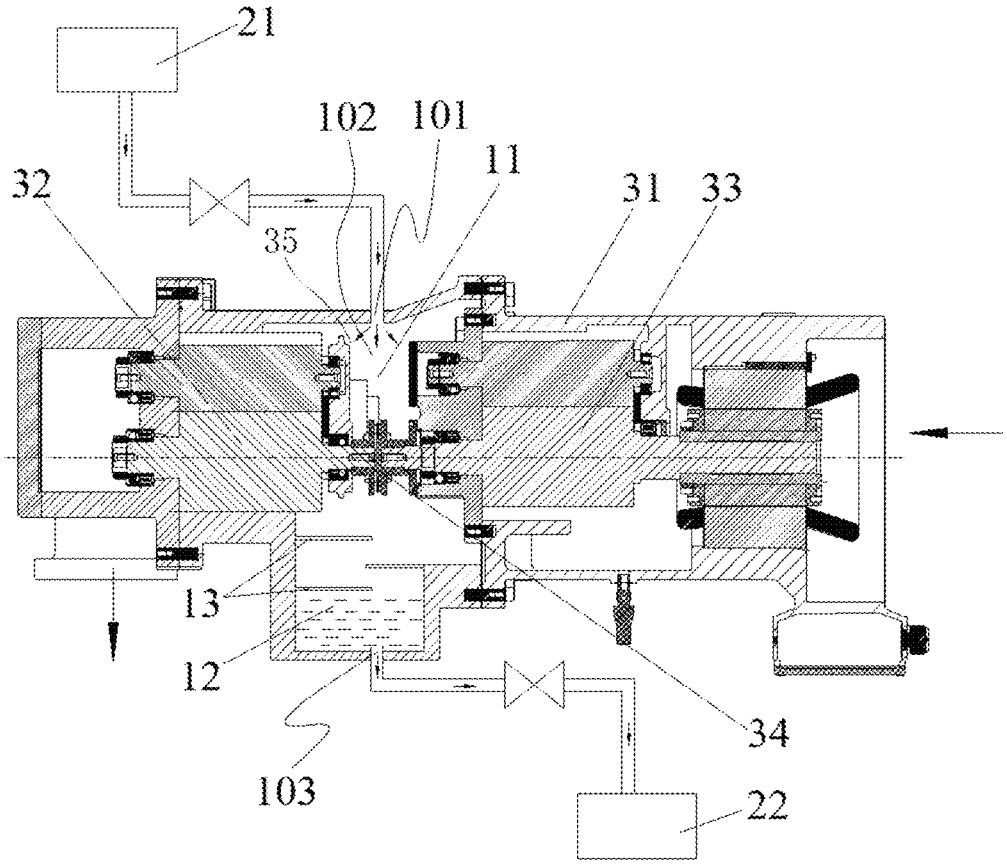
FIG. 2 is an internal structural diagram of a multi-stage compressor in Embodiment I of the present disclosure.

Referring to FIGS. 1 and 2, according to Embodiment I of the present disclosure, there is provided a multi-stage compressor including a flash tank 10. The flash tank 10 is arranged in the multi-stage compressor (a dashed box portion of FIG. 1 is a structural portion of the flash tank). A refrigerant inlet 101 of the flash tank 10 is configured to be communicated with a condenser 21, a vapor outlet 102 of the flash tank 10 is communicated with a high-pressure-stage suction port of the multi-stage compressor, and a liquid outlet 103 of the flash tank 10 is configured to be communicated with an evaporator 22.

Figure 4:
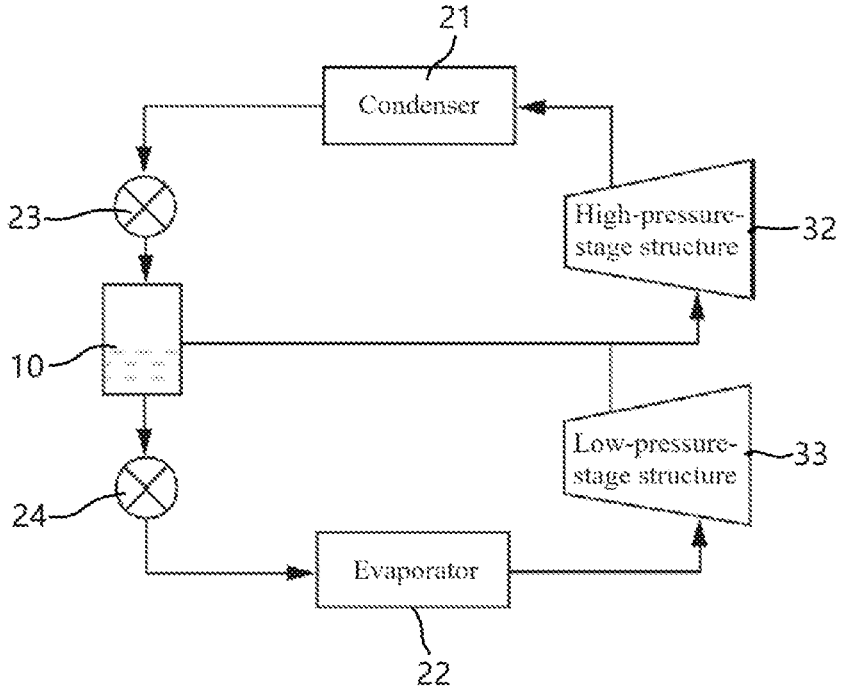
FIG. 4 is a refrigerant flow diagram of a multi-stage compressor in Embodiment I of the present disclosure.

In conjunction with a refrigerant flow diagram in FIG. 4, a refrigerating agent from the condenser 21 enters into the flash tank 10 with a lower pressure and rapidly evaporates there, generating refrigerating agent vapor, which then enters the high-pressure-stage suction port 35 of the multi-stage compressor from the vapor outlet 102 to undergo two-stage compression; the other part of the refrigerating agent cools down and then forms a saturated liquid refrigerating agent, which passes through the liquid outlet to the evaporator 22 in a main loop, enters the evaporator 22 to undergo heat transfer and evaporation and then is sucked into the compressor, thus completing the entire cycle. The structure in which the flash tank 10 is arranged in the compressor enables an enthalpy difference of a main loop refrigerating agent entering the evaporator to be increased, which increases the refrigeration capacity of the compressor per unit mass of refrigerating agent and further improves the efficiency of the compressor.

Compared with a compressor and an external make-up air structure in the related technologies, the present disclosure enables a flash tank 10 to be arranged in a compressor, which can reduce or even dispense with an external pipeline to reduce a pressure loss caused by pipeline connection, and reducing the pressure loss can effectively improve the efficiency of the compressor. In addition, the flash tank being arranged in the compressor can make the complete air conditioning unit more compact and reduce the footprint.

Referring specifically to FIG. 2, the multi-stage compressor includes a housing 31. The housing 31 is formed with a flash chamber 11 and a liquid storage area 12 of the flash tank 10. The liquid storage area 12 is located below the flash chamber 11. The refrigerant inlet 101 and the liquid outlet 103 are both provided on the housing 31, and the vapor outlet 102 and the high-pressure-stage suction port 35 are both located inside the housing 31. That is, the flash tank 10 is a structure integrally cast and molded with the multi-stage compressor. The flash chamber 11 and the liquid storage area 12 (generally a liquid storage tank structure or a liquid storage chamber structure) are formed in the housing 31, and the refrigerant inlet 101 and the liquid outlet 103 are formed, at corresponding positions, on the housing 31.

Moreover, in the present embodiment, the vapor outlet 102 and a high-pressure-stage suction port 35 (a suction port of a high-pressure-stage structure of the multi-stage compressor) are structurally merged into the high-pressure-stage suction port. That is, the high-pressure-stage suction port is the original suction port, and is also the vapor outlet 102 of the flash chamber 11. A refrigerating agent vapor formed by rapid evaporation in the flash chamber 11 directly enters the high-pressure-stage suction port 35. Of course, in other embodiments not shown in the figure, the vapor outlet 102 and the high-pressure-stage suction port 35 may also be communicated by a pipeline or by a channel formed inside the compressor.

A high-pressure-stage structure 32 and a low-pressure-stage structure 33 are provided inside the housing 31, the low-pressure-stage structure 33 is configured to make a first-stage compression of refrigerant, the high-pressure-stage structure 32 is configured to make a second-stage compression of refrigerant, and the flash tank 10 is located between the high-pressure-stage structure 32 and the low-pressure-stage structure 33. That is, the flash tank 10 is located at a medium-pressure-stage position of the multi-stage compressor. An advantage of such configuration is that the size of the complete compressor can be reduced, making the complete compressor more compact in structure and reducing the footprint.

In order to further utilize the internal structural space of the multi-stage compressor, in the present embodiment, the high-pressure-stage structure 32 and the low-pressure-stage structure 33 are disposed symmetrically and connected by a coupling 34; and the flash chamber 11 is located at a position of the coupling 34, and the liquid storage area 12 is located below the coupling 34. The high-pressure-stage structure and the low-pressure-stage structure are in mirror arrangement and are connected by the coupling.

The refrigerant inlet 101 is communicated with the flash chamber 11 and located above the flash chamber 11; and the liquid outlet 103 is communicated with the liquid storage area 12. Utilizing the action of gravity, the refrigerant inlet 101 is disposed above the flash chamber 11, so that a liquid refrigerating agent formed after evaporation of a refrigerant (refrigerating agent) entering the flash chamber 11 falls into the liquid storage area 12 along an inner wall of the housing under the action of gravity, and the liquid outlet 103 introduces the saturated liquid refrigerating agent, which has accumulated to a certain level, into the evaporator 22.

In some embodiments, a baffle plate 13 is provided inside the housing 31, and the baffle plate 13 is located between the coupling 34 and the liquid storage area 12. By providing the baffle plate 13, on the one hand, it can enhance the turbulence of the refrigerating agent to achieve rapid evaporation; on the other hand, it can avoid carrying the liquid refrigerating agent from the flash tank due to flow of an air stream during a suction process. Of course, in other embodiments not shown in the figure, it is possible to replace the baffle plate 13 with a porous filter screen, which is substantially same as in the present embodiment in the basic structure, with the only difference that the porous filter screen is provided inside the housing 31, and the porous filter screen is located between the coupler 34 and the liquid storage area 12. The porous filter screen functions to filter oil while preventing the liquid from being carried during suction.

The multi-stage compressor of the present embodiment is a two-stage compressor and is a screw compressor.

The refrigerating agent from the condenser 21 and after passing through a throttling component 23 enters from the refrigerant inlet 101 above the coupling 34 into the flash chamber 11 with a lower pressure and rapidly evaporates there, generating refrigerating agent vapor, which then enters the high-pressure-stage of the multi-stage compressor along with a suction air stream to undergo two-stage compression; the other part of the refrigerating agent cools down and then forms a saturated liquid refrigerating agent, which accumulates in the liquid storage area 12 at the bottom of the flash tank 10, and after accumulating to a certain level, the refrigerating agent at the bottom of the flash tank 10 is output from the liquid output 103, is further throttled by a second throttling element 24 in the main loop (which may be a throttling orifice plate, an electronic expansion valve, or the like), and then enters the evaporator 22 to undergo heat transfer and evaporation, and is subsequently sucked into the compressor, thus completing the entire cycle.

Figure 3:
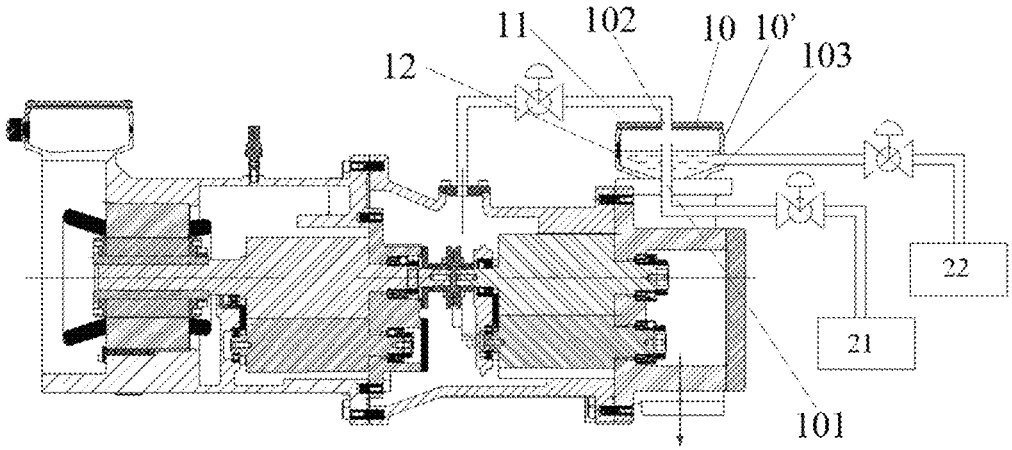
FIG. 3 is an internal structural diagram of a multi-stage compressor in Embodiment II of the present disclosure.

As shown in FIG. 3, according to embodiment II of the present disclosure, there is provided a multi-stage compressor including a flash tank 10. The flash tank 10 is arranged in the multi-stage compressor. A refrigerant inlet 101 of the flash tank 10 is configured to be communicated with a condenser 21, a vapor outlet 102 of the flash tank 10 is communicated with a high-pressure-stage suction port of the multi-stage compressor, and a liquid outlet 103 of the flash tank 10 is configured to be communicated with an evaporator 22. The flash tank 10 includes a tank structure 10', which is arranged in the interior of the multi-stage compressor, the tank structure 10' forming a flash chamber 11 and a liquid storage area 12 of the flash tank 10.

In the present embodiment, the tank structure 10' is located on an exhaust side of the multi-stage compressor. Referring to an arrow of a refrigerant flow direction for the multi-stage compressor in FIG. 3, a right side is the exhaust side of the multi-stage compressor. A refrigerating agent from the condenser 21 enters from a pipeline at the bottom into the tank structure 10' to undergo flash evaporation, then gas enters from a pipeline above into a medium pressure stage, and a refrigerating agent liquid is throttled from the bottom of lateral side and then returns to the evaporator 22.

The tank structure 10' may be disposed at a position according to the structure and internal space of the multi-stage compressor. In another embodiment not shown in the figure, a high-pressure-stage structure 32 and a low-pressure-stage structure 33 may be provided inside the multi-stage compressor, and the tank structure 10' is located between the high-pressure-stage structure 32 and the low-pressure-stage structure 33. This allows the tank structure to be located closer to or at the medium pressure stage, which can reduce a refrigerant flow distance.

According to Embodiment II of the present disclosure, an air conditioning unit is provided, which includes the multi-stage compressor of the above embodiment.

A refrigerant inlet cycle of the air conditioning unit includes a condenser 21 and an evaporator 22. The condenser 21 is communicated with the refrigerant inlet 101 of the flash tank 10, and the evaporator 22 is communicated with the liquid outlet 103 of the flash tank 10.

It is to be noted that terms as used herein are only for describing specific implementations, and are not intended to limit exemplary implementations according to the present application. As used here, unless the context clearly indicates otherwise, a singular form is also intended to include a plural form. In addition, it should also be understood that the terms "comprise" and/or "include" when used in this specification, indicate the presence of features, steps, operations, devices, components, and/or combinations thereof.

It is to be noted that the terms "first", "second" and the like in the description and claims of the present application and the above-mentioned drawings are used for distinguishing similar objects, and do not need to be used for describing a specific order or sequence. It should be understood that data so used are interchangeable under appropriate circumstances so that the implementations of the present application described here can be implemented in an order other than those illustrated or described here.

Of course, described above are preferred implementations of the present disclosure. It should be noted that those of ordinary skill in the art can also make a number of improvements and modifications without departing from the basic principles of the present disclosure, and these improvements and modifications should also be encompassed within the protection scope of the present disclosure.

The invention claimed is:

1. A multi-stage compressor, comprising:

a flash tank, which is arranged in the multi-stage compressor, wherein a refrigerant inlet of the flash tank is configured to be communicated with a condenser, a vapor outlet of the flash tank is communicated with a high-pressure-stage suction port of the multi-stage compressor, and a liquid outlet of the flash tank is configured to be communicated with an evaporator.

2. The multi-stage compressor according to claim 1, further comprising:

a housing, which is formed with a flash chamber and a liquid storage area of the flash tank, the liquid storage area being located below the flash chamber, wherein the refrigerant inlet and the liquid outlet are both provided on the housing, and the vapor outlet and the high-pressure-stage suction port are both located inside the housing.

3. The multi-stage compressor according to claim 2, further comprising a high-pressure-stage structure and a low-pressure-stage structure provided inside the housing, and the flash tank is located between the high-pressure-stage structure and the low-pressure-stage structure.

4. The multi-stage compressor according to claim 3, wherein the high-pressure-stage structure and the low-pressure-stage structure are disposed symmetrically and connected by a coupling; and wherein the flash chamber is located at a position of the coupling, and the liquid storage area is located below the coupling.

5. The multi-stage compressor according to claim 4, wherein a baffle plate is provided inside the housing, and the baffle plate is located between the coupling and the liquid storage area.

6. The multi-stage compressor according to claim 2, wherein the refrigerant inlet is communicated with the flash chamber and located above the flash chamber; and the liquid outlet is communicated with the liquid storage area.

7. The multi-stage compressor according to claim 1, wherein the flash tank comprises a tank structure, which is arranged in the interior of the multi-stage compressor, the tank structure forming a flash chamber and a liquid storage area of the flash tank.

8. The multi-stage compressor according to claim 7, wherein the tank structure is located on an exhaust side of the multi-stage compressor.

9. The multi-stage compressor according to claim 7, further comprising a high-pressure-stage structure and a low-pressure-stage structure provided inside the multi-stage compressor, and the tank structure is located between the high-pressure-stage structure and low-pressure-stage structure.

10. The multi-stage compressor according to claim 1, wherein the multi-stage compressor is a two-stage compressor.

11. An air conditioning unit, comprising the multi-stage compressor of claim 1.

12. The air conditioning unit according to claim 11, further comprising the condenser and the evaporator, the condenser being communicated with the refrigerant inlet of the flash tank, and the evaporator being communicated with the liquid outlet of the flash tank.

* * * * *